US005518244A

United States Patent [19]

Borlik

[11] Patent Number: 5,518,244

[45] Date of Patent: May 21, 1996

[54] METHOD OF USING A DRIVING AID

[76] Inventor: Stanley H. Borlik, 69560 Walnut Rd., Walkerton, Ind. 46574

[21] Appl. No.: 394,321

[22] Filed: Feb. 23, 1995

[51] Int. Cl.[6] ..... A63B 69/36

[52] U.S. Cl. ..... 473/409; 359/838; 473/218; 473/267

[58] Field of Search ..... 273/35 A, 187.6, 273/187 A; 359/838

[56] References Cited

U.S. PATENT DOCUMENTS 4,563,010 1/1986 McDorman et al. ..... 273/187.6 X
5,348,304 9/1994 Meade ..... 273/187.6

*Primary Examiner*—George J. Marlo
*Attorney, Agent, or Firm*—Baker & Daniels

[57] ABSTRACT

A method for improving the alignment and stance of a golfer who is addressing the golf ball immediately prior to hitting a golf ball. The present method uses a single mirrored device that has indicia imprinted thereon which helps the golfer coordinate the proper head, hand, and eye position with the proper club position, and further coordinates these factors with the desired destination of the ball. The golfer places the mirrored device between his feet, and uses the device to align his feet with the desired target, such as the pin or a chosen spot on the fairway. The mirrored device helps the golfer to position his body the proper distance from the golf ball, and helps the golfer to properly position his head and hands relative to each other and to the ball. Then, using the indicia on the mirrored device, the golfer is able to correctly align his hands on the club shaft and also is able to correctly align the club face with the ball in order to ensure the proper angle of contact. The present method and driving aid is adaptable to both right handed and left handed golfers, the device is easily transported in a pocket, and is equally effective when used on the fairway as well as off the tee.

4 Claims, 2 Drawing Sheets

METHOD OF USING A DRIVING AID

BACKGROUND AND SUMMARY OF THE INVENTION

This invention relates to a method for driving golf balls.

An important component of the game of golf is the ability to drive the ball straight and at the proper trajectory. However, many players systematically mis-hit the ball, resulting in a hook, a slice, or a drive that merely bounces along the ground. Such mis-hits are frequently caused by adopting a stance that is too close or too far away from the ball. Also, mishits can be caused by improper hand, head, and body position, or by the failure to maintain the proper position throughout the golfer's swing.

The present invention provides a driving aid that teaches golfers how to find and maintain the proper position for driving a golf ball. The driving aid is a mirror that is placed between a golfer's feet after the golfer has adopted the proper stance. An alignment indicator is imprinted on the mirror, and includes a first line terminating in an arrow head, a second line transverse to the first line, and a large dot or circle on the first line. In use, the first line is pointed at the target to which the ball is to be driven, such as the pin or cup. The tip of one of the golfer's feet is placed on an imaginary extension of the first line between the arrow head and the pin or cup, and the tip of the golfer's other foot is placed on an imaginary extension of the first line extending away from the pin or cup, in order to position the golfer's body relative to the ball, pin, and the device. The golf ball is placed on an imaginary extension of the second line, away from the body of the golfer. The large dot or circle on the first line is used as an aid to properly position the golfer's head and eyes. When the head, hand, and eye position is correct and coordinated with the desired direction of travel, the golfer can drive the golf ball correctly if the golfer is standing the proper distance away from the ball.

Accordingly, it is an object of this invention to provide a driving aid for use in a golf ball driving method that will aid a golfer to find and maintain the proper driving stance.

Another object of this invention is to assist a golfer in establishing the proper distance to position himself from the golf ball.

Other objects of the invention will become readily apparent to those skilled in the art upon a reading of the following description.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to best enable others skilled in the art to follow its teachings.

Figure 1:
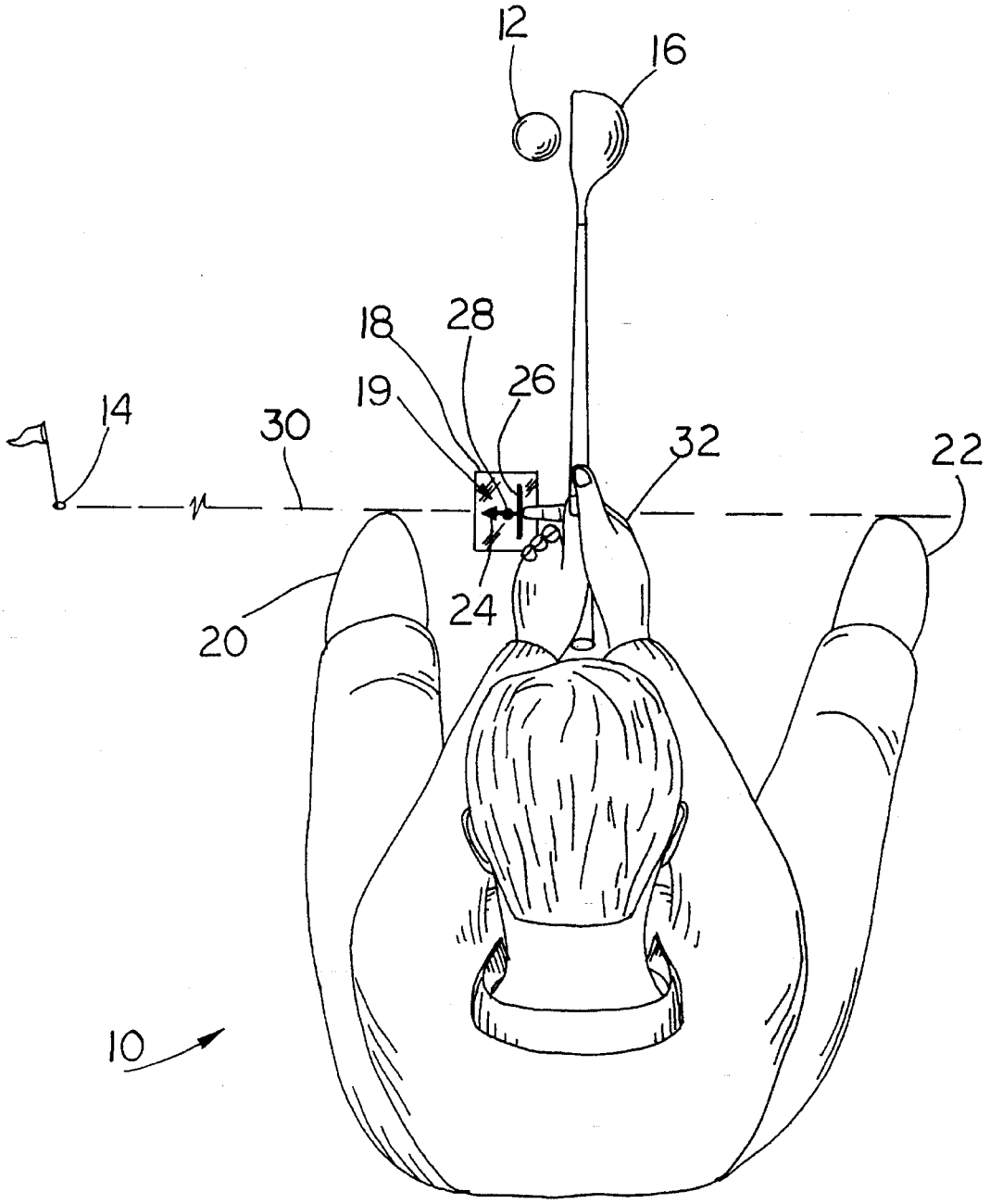
FIG. 1 plan view of a right handed golfer utilizing the present invention in order to drive a golf ball, shown with the golfer's head retracted slightly in order to illustrate what the golfer sees when he aligns his hand with the driving aid.
Figure 4:
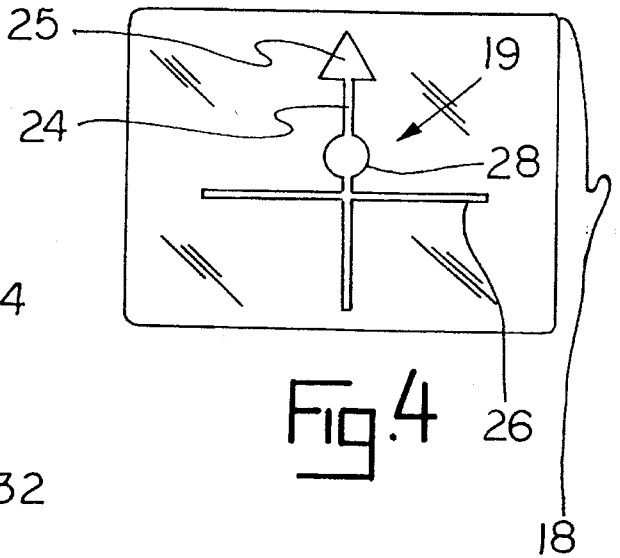
FIG. 4 is a plan view of the mirror device employed in the present invention showing the indicator means imprinted on the mirror device.
Figure 3:
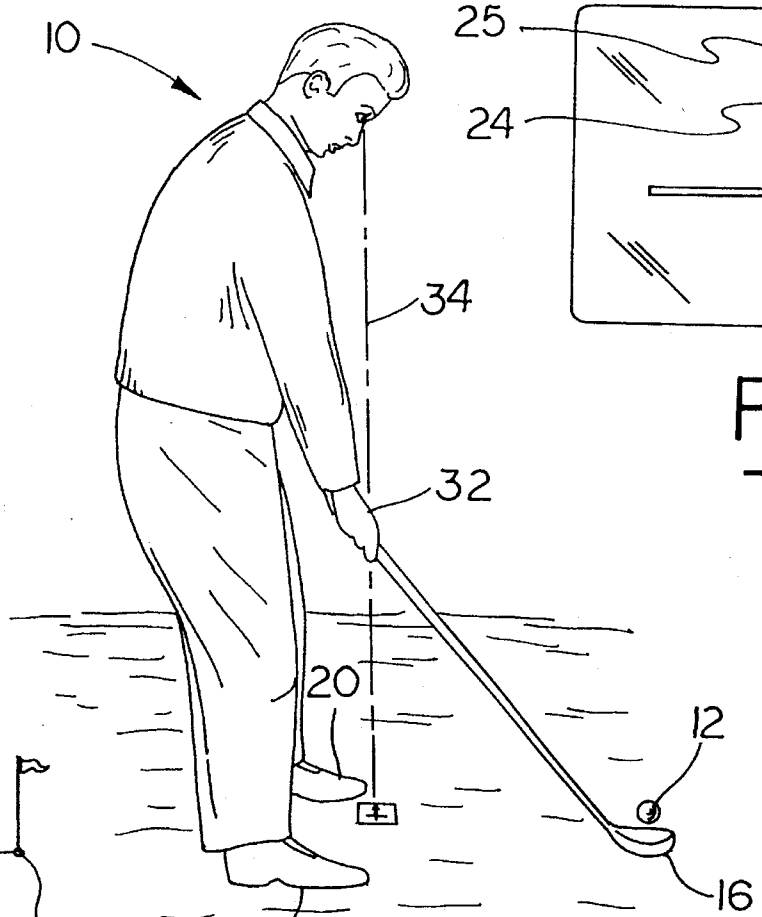
FIG. 3 is a side elevational view of the golfer shown in FIGS. 1 and 2, with the golfer's head correctly positioned so that his hands lie along the line of sight between his eyes and the driving aid.
Figure 2:
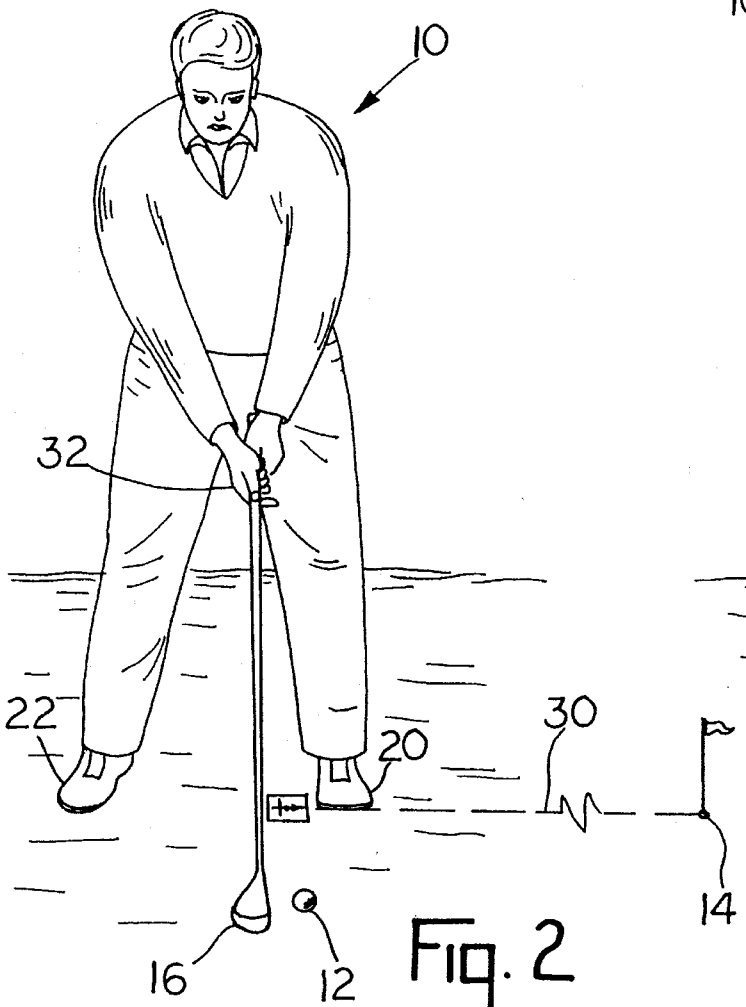
FIG. 2 is a front elevational view of the golfer shown in FIG. 1.

FIGS. 1 through 4 illustrate the mirror device and a golfer 10 employing the method of the present invention to position himself relative to the ball and the hole. The golfer 10 stands adjacent the golf ball 12 in a stance for driving the ball 12 towards the pin or target 14 using club 16. The golfer 10 places mirror 18 on the ground between his feet 20, 22, slightly to one side of the midpoint between his feet. Mirror 18 has indicia 19 imprinted thereon. Indicia 19 include a target line 24 which terminates in arrowhead 25, a ball line 26 which extends transversely to the target line 24, and an enlarged target dot or mark 28 between ball line 26 and arrowhead 25. Mirror 18 is positioned so that target arrow 24 points toward target 14 along imaginary extension 30 of target line 24, so that ball line 26 points toward the ball 12. The golfer 10 positions himself so that the tips of his feet 20, 22 are on imaginary extension 30 with the mirror between his feet. By looking at the mirror 18, the golfer 10 aligns his hands 32 with indicia 19 along the line of sight 34, and further aligns his hands with the mark 28 on target line 24.

In use, the golfer 10 stands adjacent the ball 12, and holds the club 16 in his hands so that the bottom of the club 16 is flat against the ground in order to position himself the proper distance from the ball 12. The mirror 18 with indicator 19 is placed between the feet 20, 22, so that target arrow 24 points to the target 14. The golfer positions his feet 20, 22 so that his toes abut imaginary extension 30. Thus the golfer's feet are positioned correctly relative to the ball and the pin.

The golfer 10 then looks at mirror 18, and aligns his hands 32 along his line of sight 34 so that the reflection from his hands and eyes are visible on mirror 18 and in line with indicia 19. Golfer 10 uses the mark 28 on mirror 18 in order to correctly position his hands relative to the ball and his body, by aligning the hands 32 so that the reflection of the hands is aligned with the mark 28. Thus, the golfer is the proper distance from the ball, and the head, hands, and eyes are in the proper position to start the swing. The golfer 10 then attempts to maintain the proper position throughout the swing in order to drive the ball 12 towards target 14.

It is understood that the above description does not limit the invention to the above-given details, but may be modified within the scope of the following claims.

I claim:

1. A method for assisting a golfer using a golf club in obtaining a proper body position before driving a golf ball towards a target comprising the steps of:

a) standing adjacent said golf ball in a stance for driving said ball;

b) placing a mirror having indicia imprinted thereon on the ground between the feet, said indicia including a target line terminating in an arrowhead, a ball line extending transversely to said target line, and a mark on said target line between said ball line and said arrowhead;

c) standing over said mirror and aligning the head, hands, arms, and eyes of the user with the mirror by looking at the reflection of the golfer's hands and eyes in said mirror;

d) aligning said target line and said arrowhead with said target to define an imaginary line between the mirror and the target;

e) aligning a golf ball with said ball line;

f) squaring the face of the club to the ball by aligning the golfer's hands and eyes with said mark by looking at the reflection of the golfer's hands and eyes on said mirror and aligning said reflections with said mark; and g) maintaining the stance while driving the golf ball towards said target.

2. The method of claim 1, wherein said method includes the additional step of:

h) positioning the tips of the user's feet along said imaginary line on opposite sides of the mirror.

3. The method of claim 1 including the additional step of:

i) placing said mirror slightly to one side of the midpoint between the feet.

4. The method of claim 1 including the additional step of:

j) holding said club so that the bottom of said club is resting flat on the ground.

* * * * *